US007641183B2

(12) United States Patent
Fuller et al.

(10) Patent No.: US 7,641,183 B2
(45) Date of Patent: Jan. 5, 2010

(54) BAR CLAMP WITH SIDE-ACTIVATED BRAKING LEVER

(75) Inventors: Anthony B. Fuller, Mooresville, NC (US); Scott Daniel Springer, Westmont, IL (US); Thomas M. Chervenak, Stanley, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/520,773

(22) PCT Filed: Jul. 7, 2003

(86) PCT No.: PCT/US03/21197

§ 371 (c)(1),
(2), (4) Date: Nov. 14, 2005

(87) PCT Pub. No.: WO2004/004976

PCT Pub. Date: Jan. 15, 2004

(65) Prior Publication Data

US 2006/0131802 A1 Jun. 22, 2006

(51) Int. Cl.
*B25B 1/00* (2006.01)

(52) U.S. Cl. ..... 269/6; 269/3

(58) Field of Classification Search ..... 259/106, 259/107; 269/6, 166–171.1, 3; 254/106–111
See application file for complete search history.

(56) References Cited

U.S. PATENT DOCUMENTS 552,795 A 1/1896 Thompson
589,046 A 8/1897 Terry
707,680 A * 8/1902 De Worth ..... 269/203
766,145 A 7/1904 Greer
836,303 A 11/1906 Christensen
911,048 A 2/1909 King
1,237,122 A 8/1917 Suomy
1,392,391 A 10/1921 Bartz
1,412,821 A 4/1922 Anderson
2,391,143 A 12/1945 Ertner
2,424,313 A * 7/1947 Heinrich ..... 269/168
2,543,824 A 3/1951 Beeseley et al.
2,574,227 A 11/1951 Sarvle
2,689,496 A 9/1954 Chappell
2,849,204 A 8/1958 Patrick et al.
4,647,027 A 3/1987 Shafto
4,867,427 A 9/1989 Cunningham
4,874,155 A 10/1989 Goul
4,901,990 A 2/1990 Frechette
4,926,722 A 5/1990 Sorensen et al.
5,005,449 A 4/1991 Sorensen et al.

(Continued)

FOREIGN PATENT DOCUMENTS

GB 1 472 278 5/1977
GB 2 178 689 A 2/1987
GB 2 204 264 A 11/1988

*Primary Examiner*—Lee D Wilson
(74) *Attorney, Agent, or Firm*—R. Brian Drozd; Moore & Van Allen, PLLC

(57) ABSTRACT

A clamp that includes a first clamping jaw, a support element to which the first clamping jaw is attached and a clamp body having a first slot through which the support element passes along a first direction and an opening that faces in a direction that is substantially perpendicular to the first direction. A handle grip attached to the clamp body, a braking lever and a brake actuator that contacts the braking lever and includes an engagement element that extends through the opening.

41 Claims, 11 Drawing Sheets

U.S. PATENT DOCUMENTS

| | | | | |
|---|---|---|---|---|
| 5,009,134 | A | 4/1991 | Sorensen et al. | |
| D316,661 | S | 5/1991 | Burney | |
| 5,022,137 | A | 6/1991 | Sorensen et al. | |
| D320,919 | S | 10/1991 | Sorensen | |
| 5,094,131 | A | 3/1992 | Sorensen et al. | |
| D328,846 | S | 8/1992 | Sorensen et al. | |
| 5,170,682 | A | 12/1992 | Sorensen et al. | |
| D333,602 | S | 3/1993 | Gatzemeyer et al. | |
| 5,222,420 | A | 6/1993 | Sorensen et al. | |
| 5,853,168 | A * | 12/1998 | Drake | 269/6 |
| 6,279,431 | B1 * | 8/2001 | Seber et al. | 81/357 |
| 6,338,475 | B1 * | 1/2002 | Ping | 269/6 |
| 6,412,767 | B1 | 7/2002 | Beckmann et al. | |
| 6,648,315 | B1 * | 11/2003 | Lee | 269/6 |
| 2003/0015068 | A1 | 1/2003 | Poole et al. | |
| 2006/0131802 | A1 * | 6/2006 | Fuller et al. | 269/6 |

* cited by examiner

BAR CLAMP WITH SIDE-ACTIVATED BRAKING LEVER

Applicants claim, under 35 U.S.C. §§ 120 and 365, the benefit of priority of the filing date of Jul. 7, 2003 of a Patent Cooperation Treaty patent application, copy attached, Serial Number PCT/US2003/021197, filed on the aforementioned date, the entire contents of which are incorporated herein by reference, wherein Patent Cooperation Treaty patent application Serial Number PCT/US2003/021197 was published under PCT Article 21(2) in English and Applicants claim, under 35 U.S.C. § 119, the benefit of priority of the filing dates of: Jul. 9, 2002, of U.S. Provisional Patent Application Ser. No. 60/395,800 filed on the aforementioned date, the entire contents of which are incorporated herein by reference, and 2) Jun. 2, 2003, of U.S. Provisional Patent Application Ser. No. 60/475,132 filed on the aforementioned date, the entire contents of which are incorporated herein by reference.

BACKGROUND OF THE INVENTION

1. Field of the Invention

This invention relates to a clamp that has a braking lever that is activated on a side of the clamp.

2. Discussion of Related Art

Bar clamps for clamping objects into position are well known in the art. In recent years, advances have been made in bar clamps that enable them to be operated by a single hand. An example of such a bar clamp is disclosed in U.S. Pat. No. 4,926,722 which discloses a trigger mechanism to move a movable clamping jaw toward a fixed clamping jaw. The movable clamping jaw is attached to a moving bar.

Spreading clamps that are operable by a single hand are also well known, such as described in U.S. Pat. No. 5,009,134. Again, the movable jaw is attached to a bar.

In bar clamps and spreading clamps similar to those disclosed above, a braking lever is positioned forwardly of the trigger handle so that the braking lever is actuated by a finger of the hand holding the clamp. In other types of bar clamps, the braking lever is positioned rearwardly of the trigger handle so that the braking lever is actuated by a thumb of the hand holding the clamp.

One disadvantage of such braking levers is that they often require significant pressure/force to release the braking lever.

A second disadvantage of such braking levers is that they typically create "pinch points." For example, in the case of the above-mentioned thumb actuated braking lever, the braking lever can pinch the gripping band as the braking lever moves towards the clamp body.

A third disadvantage for forwardly positioned braking levers is that there are isolated instances where the braking levers can be positioned so near the workpiece being clamped that they interfere with the workpiece.

SUMMARY OF THE INVENTION

One aspect of the present invention regards a clamp that includes a first clamping jaw, a support element to which the first clamping jaw is attached and a clamp body having a first slot through which the support element passes along a first direction and a second slot that faces in a direction that is substantially perpendicular to the first direction. A handle grip attached to the clamp body. A braking lever that is normally positioned so as to engage the support element so as prevent the support element and the first clamping jaw from moving away from the second clamping jaw and allowing the first clamping jaw to move towards the second clamping jaw.

A brake actuator that contacts the braking lever and comprises an ear that extends through the second slot.

A second aspect of the present invention regards a clamp that includes a first clamping jaw, a support element to which the first clamping jaw is attached and a clamp body having a first slot through which the support element passes along a first direction and an opening that faces in a direction that is substantially perpendicular to the first direction. A handle grip attached to the clamp body, a braking lever and a brake actuator that contacts the braking lever and includes an engagement element that extends through the opening.

One or more of the above aspects of the present invention provides the advantage of improving the flexibility in operating a clamp.

One or more of the above aspects of the present invention provides the advantage of decreasing the amount of pressure force required to release a braking lever.

One or more of the above aspects of the present invention provides the advantage of increasing control of a clamp when releasing a braking lever.

One or more of the above aspects of the present invention provides the advantage of decreasing the chance that the braking lever engages the hand of the user of the clamp.

One or more of the above aspects of the present invention provides the further advantage of reducing the chance that a braking lever will interfere with a workpiece that is being clamped by a clamp.

The foregoing features and advantages of the present invention will be further understood upon consideration of the following detailed description of the invention taken in conjunction with the accompanying drawings, in which:

DESCRIPTION OF THE PREFERRED EMBODIMENT(S)

Figure 1:
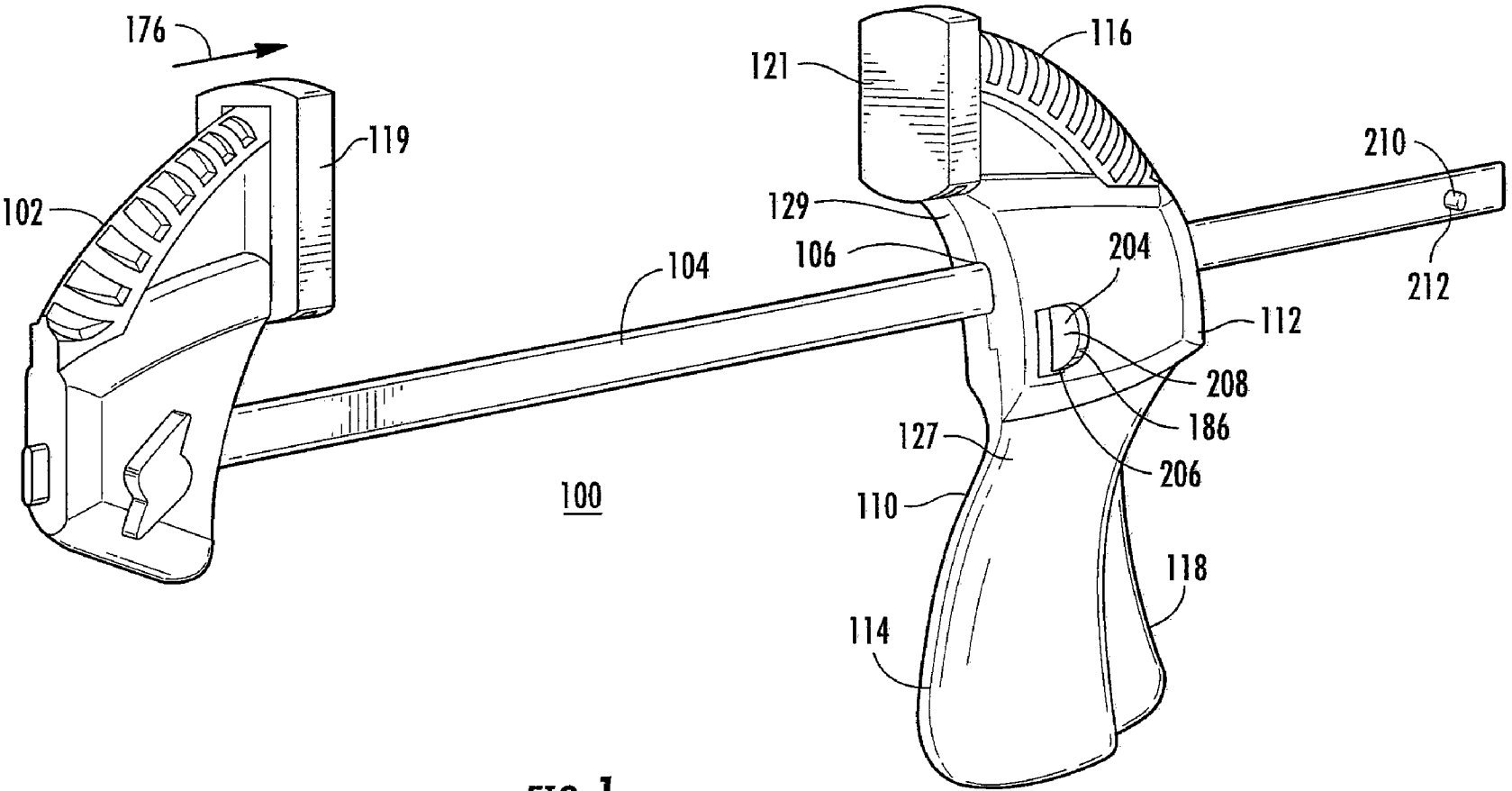
FIG. 1 shows a left perspective view of an embodiment of a bar clamp according to the present invention.

Referring now to the drawings wherein like reference characters designate identical or corresponding parts throughout the several figures, and in particular FIG. 1 shows a clamp, such as bar clamp 100. The bar clamp 100 includes a clamping jaw 102 connected to a support element, such as a rod or a bar 104. The clamping jaw 102 may be fixed to the rod or bar 104 via a pin in the manner disclosed in U.S. Pat. No. 4,926,722 or it may have a detachable structure.

Figure 2:
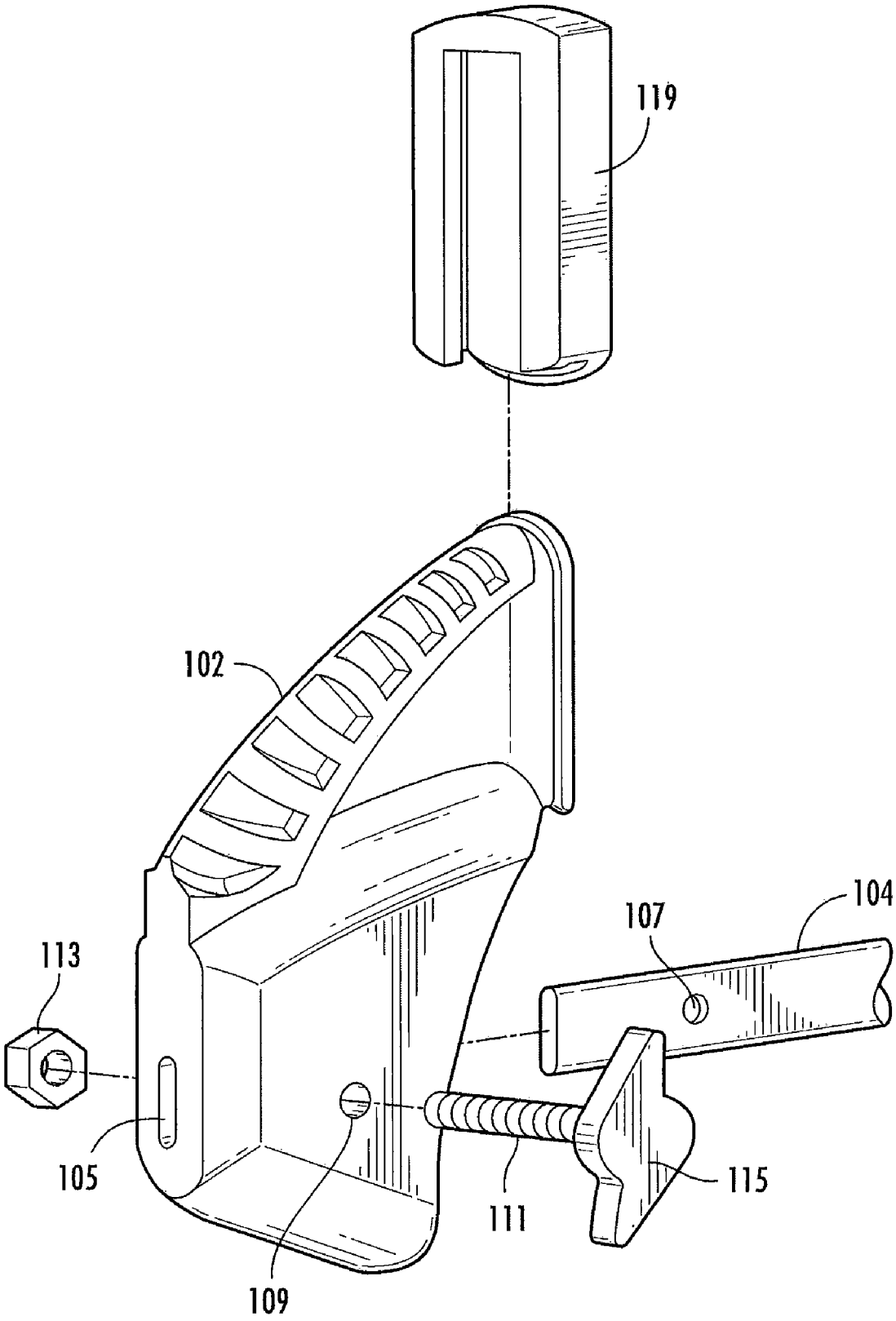
FIG. 2 shows a right perspective and exploded view of an embodiment of a movable clamping jaw to be used with the bar clamps of FIGS. 1 and 9 in accordance with the presenting invention.

An example of a possible detachable structure is shown in FIG. 2. In this embodiment, the bar 104 is slid into a slot 105 formed in the clamping jaw 102. The openings 107 and 109 of the bar 104 and clamping jaw 102, respectively, are aligned with one another so that a bolt 111 is inserted therethrough. A nut 113 is threaded onto the threads of the bolt 111 until it engages a side of the clamping jaw. Thus, the clamping jaw 102 is attached to the bar 104. The clamping jaw 102 is detached from the bar 104 by holding the handle 115 of the bolt 111 and rotating the nut 113 until the nut is disengaged from the threaded portion of the bolt 111.

Figure 3:
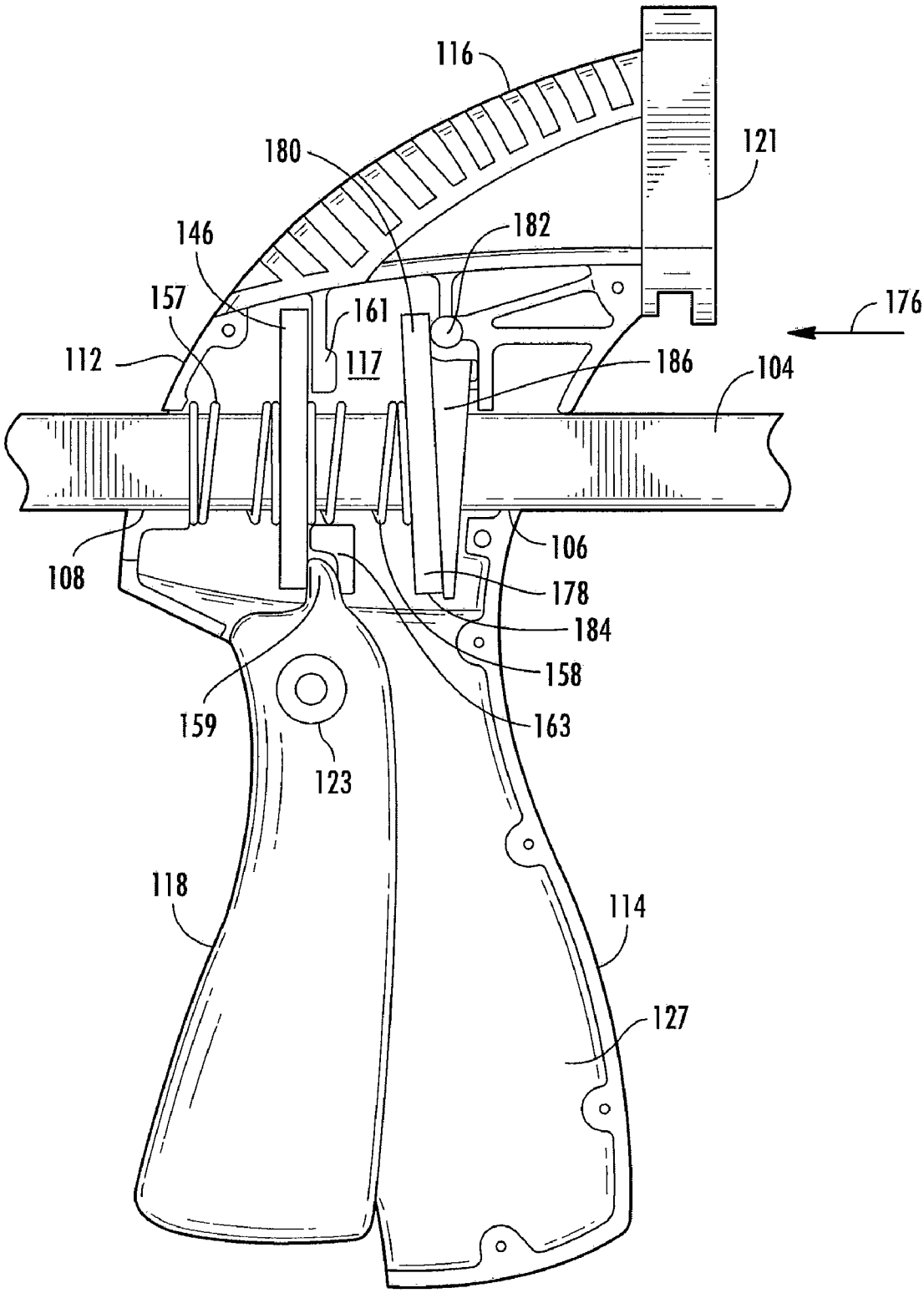
FIG. 3 shows a partially opened right side view of an embodiment of a handle/grip assembly used with the bar clamp of FIG. 1 in accordance with the present invention.
Figure 4:
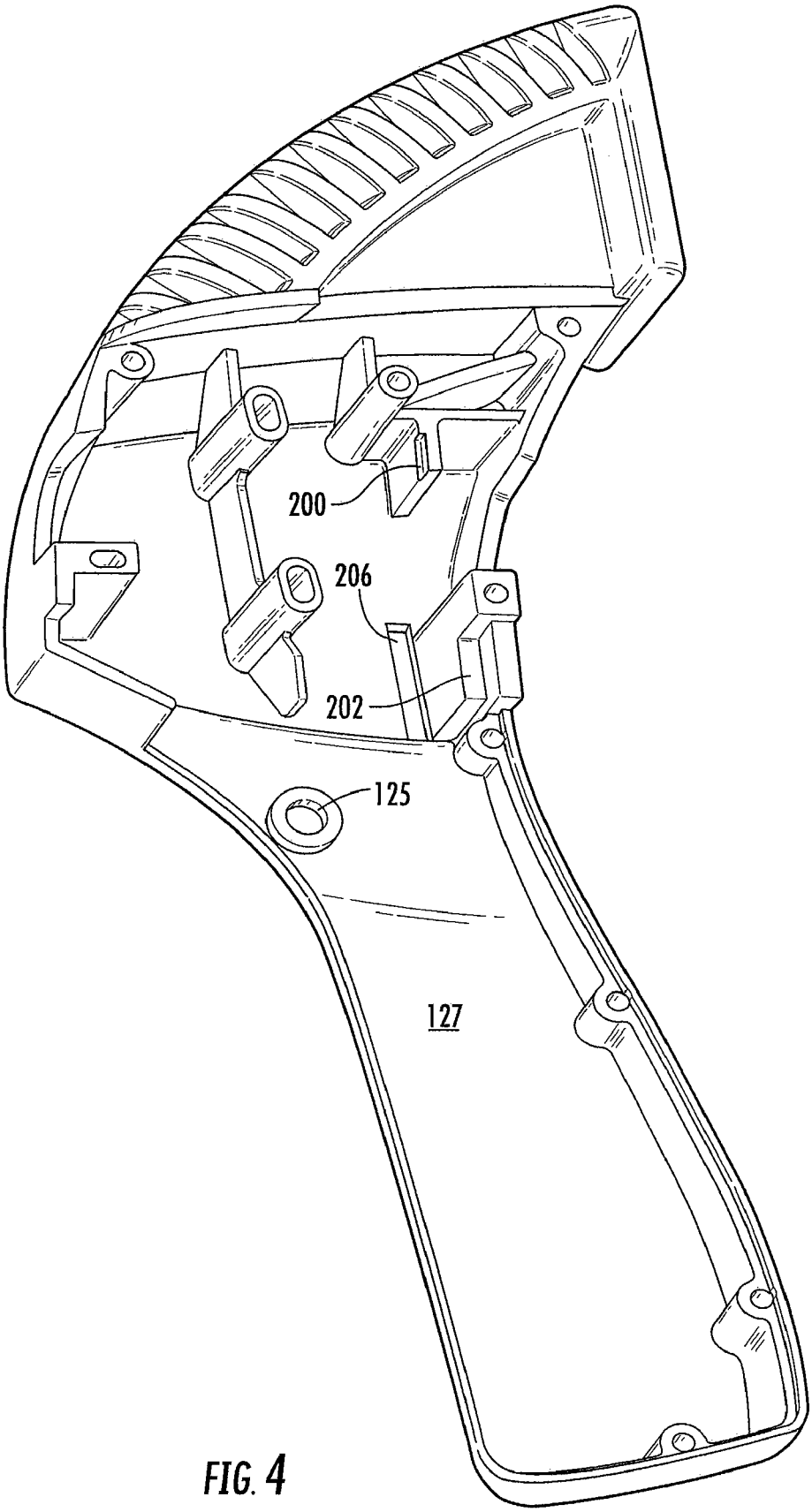
FIG. 4 shows a perspective view of an interior of a left piece of an embodiment of a clamp body used with the bar clamp of FIG. 1.
Figure 5:
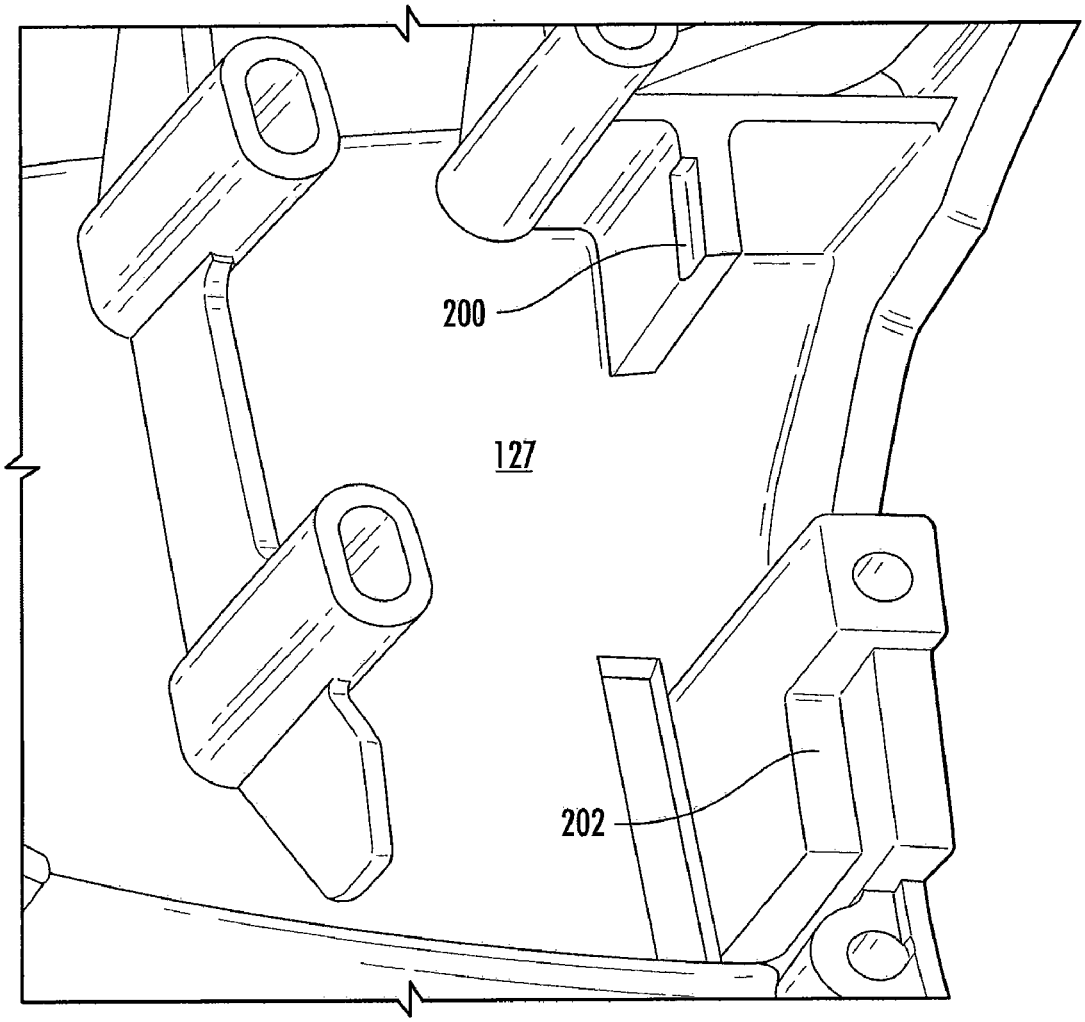
FIG. 5 shows an enlarged view of a portion of the interior of the left piece of FIG. 4.

As shown in FIGS. 1 and 3, the bar 104 is slidably supported in a proximal slot or bore 106 and a distal slot or bore 108, each of which passes through a handle/grip assembly 110. The handle/grip assembly 110 includes a clamp body 112 through which the slots 106 and 108 pass, a handle grip 114 attached to the clamp body 112 on one side of the slots 106 and 108, and a fixed clamping jaw 116 attached to the clamp body 112 on the other side of the slots 106 and 108. A cavity 117 in the clamp body 112 divides the bores 106 and 108 from one another. Note that the clamp body 112 is formed from left and right portions 127, 129. As shown in FIGS. 4 and 5 the interior of the left portion 127 has a plurality of female receptors that receive corresponding male members of the right portion 129 after the braking lever, springs, and brake actuator have been inserted into the clamp body 112. After right and left portions 129,127 aye fitted together ultrasonic welding of the portions creates a permanent bond that attaches clamp together. Note that other modes of attachment are possible. For example, the left and right portions 127, 129 can be attached to one another by either a snap fit system, mechanical fasteners, such as screws, or an adhesive or glue. On another matter, protective pads 119, 121 may be attached to the jaws 102 and 116, respectively.

A trigger handle 118 is pivotably mounted to the body 112 below and between the slots 106 and 108. In particular, the trigger handle 118 includes a pair of female receptors 123 located on opposite sides of the trigger handle 118. Corresponding annular male members 125 formed in left and right portions 127, 129 of the clamp body 112 are inserted into the female receptors 123. Once inserted in the receptors 123, the trigger handle 118 is pivotable about an axis P aligned with the receptors 123. The axis P is positioned approximately 1.5 inches below the bottom of the bar 104, approximately 1.25 inches from a proximal edge of the slot 108 and approximately ⅜ inches from a distal edge of the slot 106.

The bar 104 and clamping jaw 102 are incrementally moved toward the fixed clamping jaw 116 via the actuation of one or more driving levers 146. As shown in FIG. 3, the driving lever 146 is suspended on the bar 104, which passes through lower a rectangular hole formed in the driving lever 146. The driving lever 146 has a rectangular-like shape and is made of a resilient material, such as steel. Note that in the case when multiple driving levers are used, each driving lever 146 is identical in shape.

As shown in FIG. 3, a pair of identical steel springs 157 and 158 is positioned at either side of the driving lever 146. Each of the springs 157 and 158 encircles the bar 104. The spring 157 has one end that engages a portion of the clamp body 112 near the slot 108 and another end that engages a rear face of the driving lever 146. The spring 158 has one end that engages a front face of the driving lever 146 and another end that engages a rear face of a braking lever 178. The configuration and structure of the springs 157 and 158 are such that they bias the driving lever 146 to a vertical position when the trigger handle 118 is not actuated as shown in FIG. 3. At this vertical position, the front face of the driving lever 146 contacts or is adjacent to an engagement piece 159 of the trigger handle 118 and an upper stop 161 and a lower stop 163 of the clamping body 112. Note that while the springs 157 and 158 are preferably identical, this is not necessary for the purposes of the present invention.

As shown in FIG. 3, a braking lever 178 is suspended from the bar 104. The bar 104 passes through a rectangular opening formed in the braking lever 178. A top end 180 of the braking lever 178 contacts a pivot element 182 formed in the clamp body 112. As shown in FIG. 3, when the trigger handle 118 is not actuated, the spring 158 biases the braking lever 178 so that it rotates counterclockwise and is angled with respect to the vertical direction. In this position, the braking lever 178 binds with the bar 104 when the edges of its opening engages the surface of the bar 104. Thus, the spring 158 normally simultaneously biases and positions the free end 184 of the braking lever 178 away from the trigger handle 118. The normally biased position of the braking lever 178 is limited by the binding interference and engagement between the opening of the braking lever 178 with the bar 104 so as to engage the bar 104 and prevent the bar 104 and the movable clamping jaw 102 from moving away from the fixed clamping jaw 116 while allowing the clamping jaw 102 to move towards the fixed clamping jaw 116.

If a force is applied to the movable jaw 102 of FIG. 1 in the direction indicated by the arrow 176, the bar 104 is free to move through the opening of the braking lever 178 and through the holes formed in the driving lever 146. Because the braking lever 178 is free to pivot against the bias of the spring 158 when force is applied on the movable jaw 102 in the direction of the arrow 176, the braking lever 178 does not engage the bar 104 and so does not present any obstacle to this motion of the bar 104 and the movable jaw 102 may be advanced continuously towards the fixed jaw 116.

Incremental motion of the bar 104 and the attached movable jaw 102 toward the fixed jaw 116 is made possible by squeezing the trigger handle 118 one or more times in a direction opposite to that indicated by the arrow 176. Squeezing of the trigger handle 118 causes the engagement piece 159 of the trigger handle 118 to push the driving lever 146 along the direction 176 shown in FIG. 3. Since the driving lever 146 engages the bar 104, the bar 104 travels with the driving lever 146 along the direction 176. As the trigger handle 118 is repeatedly squeezed, the movable jaw 102 approaches the fixed jaw 116 in an incremental manner. After a while, the object to be clamped will be engaged by both jaws 102 and 116. Continued squeezing of the trigger handle 118 causes the pressure or force exerted on the object and the jaws to increase.

Note that when the driving lever 146, braking lever 178 and the trigger handle 118 are not manually engaged and a force is applied to the movable jaw 102 of FIGS. 1 and 3 in the direction opposite to the direction indicated by the arrow 176, the edges of the opening formed in the braking lever 178 binds against the surface of the bar 104 and it is not possible, without further action, to withdraw the movable jaw 102 further away from the fixed jaw 116.

Figure 6:
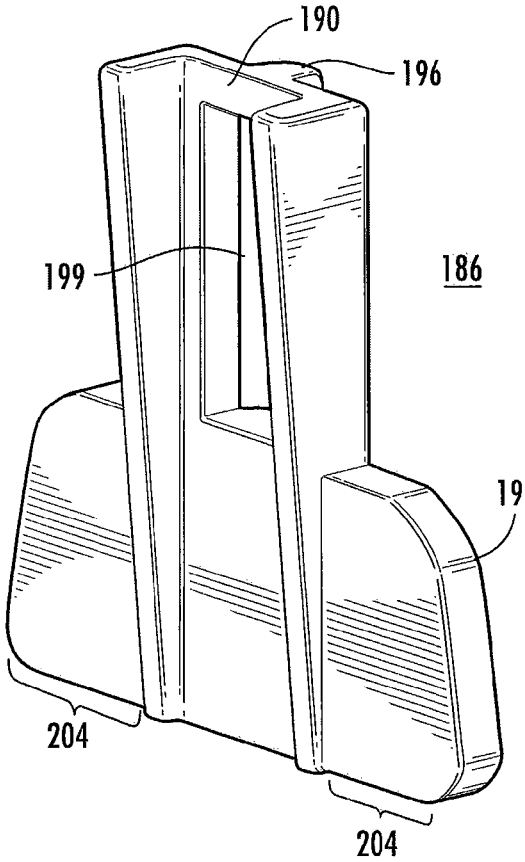
FIG. 6 shows a right rear perspective view of an embodiment of a brake actuator to be used with the bar clamp of FIG. 1 in accordance with the present invention.
Figure 7:
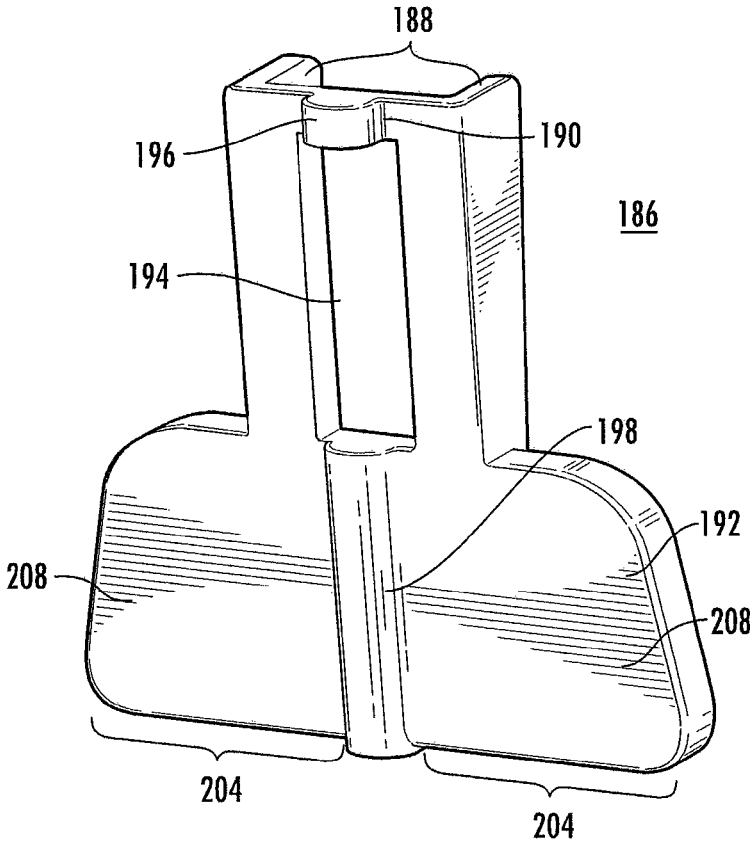
FIG. 7 shows a front perspective view of the brake actuator of FIG. 6.
Figure 8:
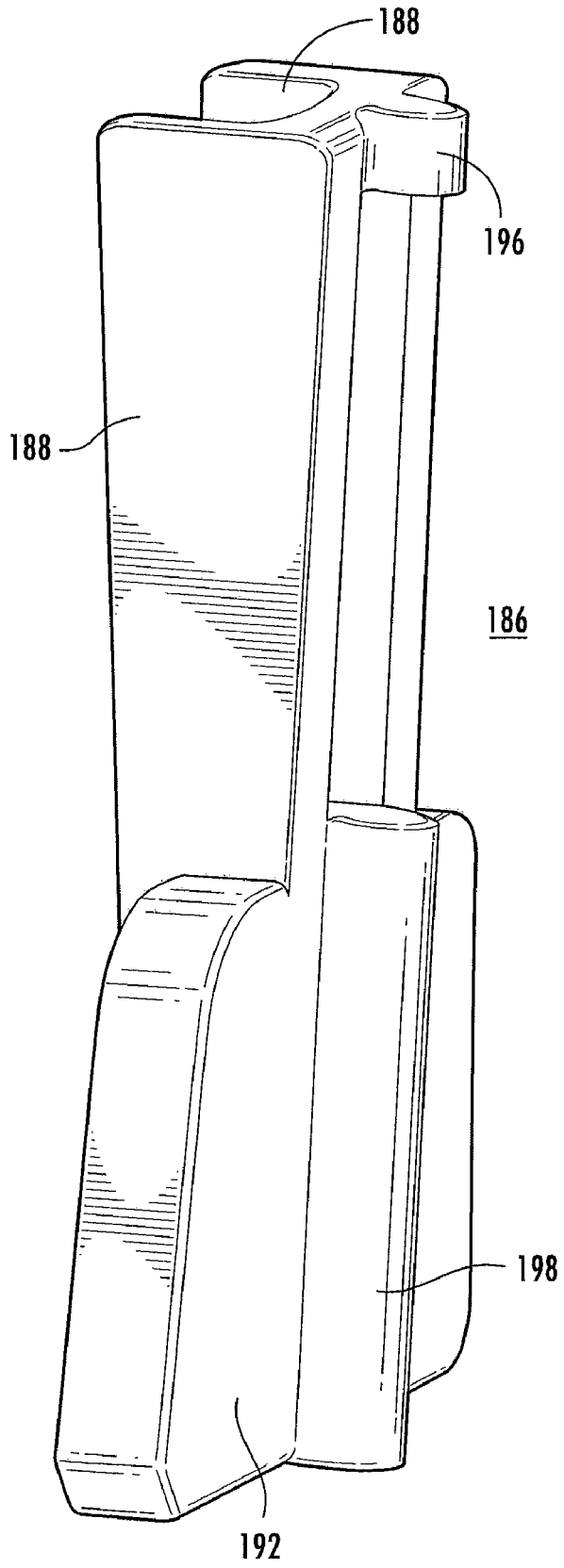
FIG. 8 shows left side perspective view of the brake actuator of FIG. 6.

A clamped object is released from the jaws 102 and 116 by actuating a butterfly-shaped brake actuator 186. The brake actuator 186 is preferably injected molded resin and has a thickness of approximately 0.25 inches. As shown in FIGS. 6-8, the brake actuator 186 includes a pair of trapezoidal-shaped ribs 188 that are joined by a top piece 190 and a bottom base 192. The ribs 188, top piece 190 and bottom base 192 define a rectangular opening 194 through which the bar 104 is inserted as shown in FIG. 3.

The brake actuator 186 has a top insertion member 196 and a bottom insertion member 198 that are used to prevent swaying of the brake actuator 186. In particular, the insertion member 196 is received within a semi-circular recess formed when a partial recess 200 of one of the parts 127, 129 is adjacent to a mirror image recess formed in the other part when the parts are joined to one another. Similarly, a top portion of the insertion member 198 is received within a semi-circular recess formed when a partial recess 202 of one of the parts 127, 129 is adjacent to a mirror image recess formed in the other part. The brake actuator 186 is further constrained in its movement by having the left and right ears 204 of the bottom base 192 extending through side rectangular apertures 206 formed in the parts 127, 129. The ears 204 extend past the apertures 206 and the clamp body 112 by an amount ranging from ⅝ inches to ¾ inches. The apertures 206 are aligned with one another and face in a direction substantially perpendicular to direction 176. As shown in FIG. 3, the constrained brake actuator 186 has a trapezoidal shape that is angled so as to match the angled orientation of the braking lever 178.

One mode of actuation of the brake actuator 186 is accomplished by having the thumb of the hand grasping the handle grip 110 and the trigger handle 118 be positioned so as to press against a rear face 214 of an ear 204 nearest the thumb. Pressing the brake actuator 186 in this manner causes the insertion members 196, 198 to be pressed into the recesses. Such pressing also causes the pressed ear 204 of the brake actuator 186 to pivot away from the braking lever while the unpressed ear pivots towards the braking lever about an axis L that is aligned with and intersects the insertion members 196, 198. Consequently, the rib 188 associated with the unpressed ear contacts the front face of the braking lever 178 causing the braking lever 178 to pivot about the pivot element 182 to a substantially vertical position with respect to the direction of intended motion of the bar 104. Note that in the above actuation process, the brake actuator 186 allows most of the hand grasping the clamp to stay in contact with the clamp while the thumb engages a single ear thus allowing for better control of clamp when releasing the braking lever 178. Note that if both rear faces of the ears 204 are pressed simultaneously and equally, the ears 204 will be unable to pivot about axis L and so the bottom base 109 will be unable to cause the braking lever 178 to move to the substantially vertical position.

A second mode of actuation of the brake actuator 186 is accomplished by simultaneously pressing against one or both front faces 208 of the ears 204. Pressing the brake actuator 186 in this manner causes the insertion members 196, 198 to be removed from the recesses and thus reduces their ability to pivot about axis L. Such pressing also causes the pressed ears 204 to translationally move toward the braking lever 178. Consequently, both ribs 188 contact the front face of the braking lever 178 causing the braking lever 178 to pivot about the pivot element 182 to a substantially vertical position with respect to the direction of intended motion of the bar 104.

In either one of the modes of actuation of the brake actuator discussed above, once the vertical position is achieved, the edges of the opening of the braking lever 178 no longer bind with the bar 104. Accordingly, the bar 104 is free to slide in either direction through the openings in the driving and braking levers 146, 178. Based on the above description of the two modes of actuation, the brake actuator 186 increases the flexibility of operating the clamp by allowing actuation of the ears at either side of the clamp body 112 and from either face of the ears. Furthermore, the improved moment arm of the brake actuator that acts on the braking lever decreases the amount of pressure/force required to release the braking lever.

Note that the resin material of the brake actuator 186 reduces the shock transmitted from the braking lever to the hand holding the clamp when the braking lever is released. The side position of the ears 204 of the brake actuator 186 provides the further advantages of reducing the risk of interference of the brake actuator with the workpiece being clamped by the clamp and reducing risk of pinching the hand of the user of the clamp.

Note that the bar 104 has a rectangular cross-section. Of course, the bar 104 may have other cross-sectional shapes, such as a square, a circle, or a triangle. The openings in the driving lever 146 and the braking lever 178 are shaped to accommodate the cross-sectional shape of the bar 104 to provide proper binding interference with the bar 104. Note that the bar 104 has a second opening 210. A cylindrical stop element 212 may be inserted into and permanently attached within the opening 212 so that the stop element 212 extends substantially perpendicular to the longitudinal axis of the bar 104. As the movable jaw 102 is moved away from the fixed jaw 116, the stop element 212 nears the rear of the slot 108. Upon reaching the rear of the slot 108, the ends of the stop element 212 contact the clamping body 112 outside of the slot 108. Thus, the stop element 212 prevents the movable jaw 102 from moving further away from the fixed jaw 116.

The bar clamp 100 of FIGS. 1-8 can be arranged to be a spreading clamp. This is accomplished by removing the movable jaw 102 in the manner described previously. Next, the bar 104 is removed from the clamp body 112 and reinserted so that the stop element 212 and opening 107 have switched positions. At this stage, the clamping jaw 102 is reattached to the bar 104, via opening 107, wherein the clamping pad 119 faces away from the clamping jaw 116.

Figure 9:
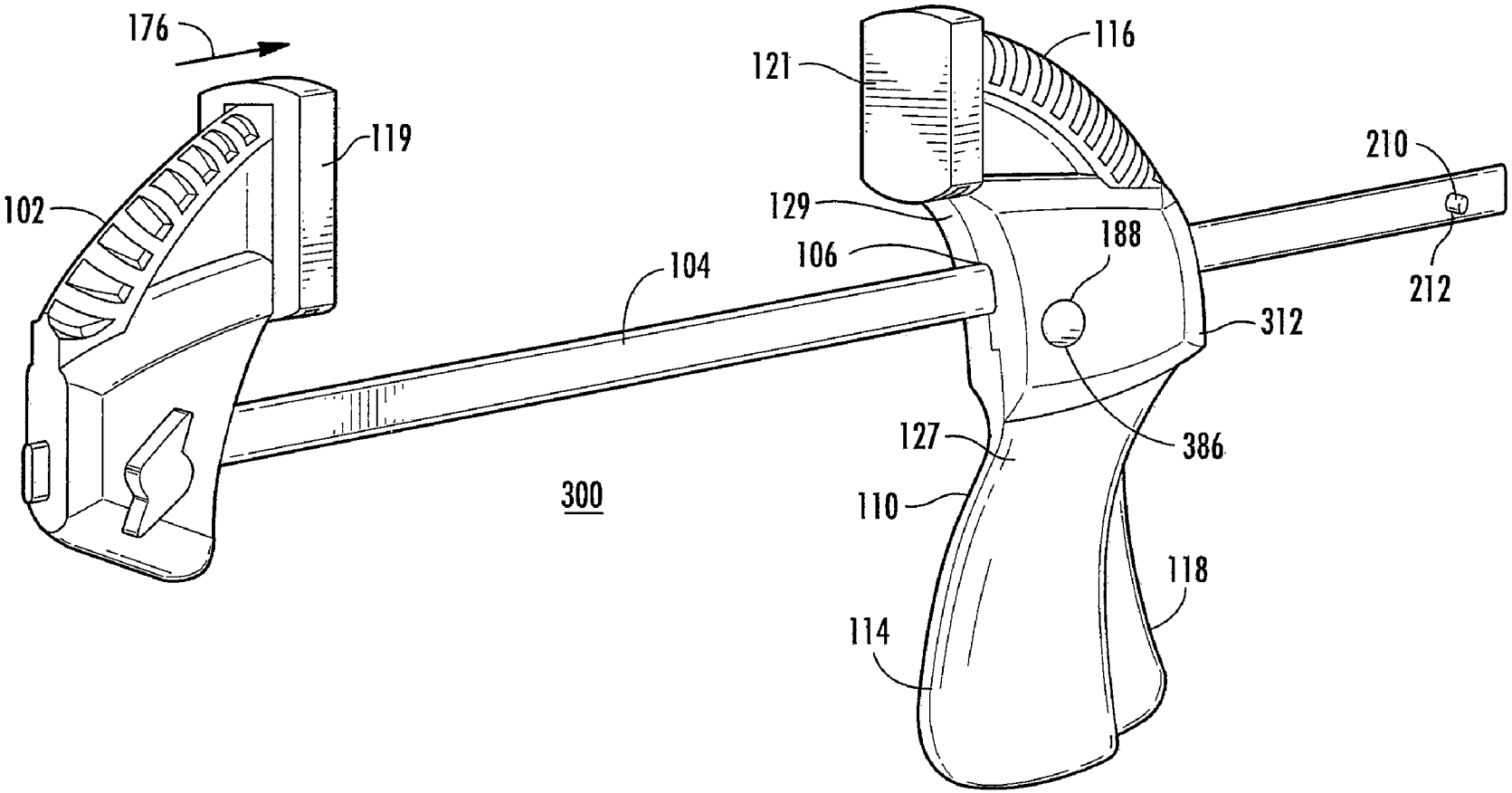
FIG. 9 shows a left perspective view of a second embodiment of a bar clamp according to the present invention.

Other embodiments of a clamp in accordance with the present invention are shown in FIGS. 9-17. In particular, FIG. 9 shows a clamp, such as bar clamp 300. The bar clamp 300 includes a clamping jaw 102 connected to a support element, such as a rod or a bar 104. The clamping jaw 102 may be fixed to the rod or bar 104 via a pin in the manner disclosed in U.S. Pat. No. 4,926,722 or it may have a detachable structure such as previously described with respect to FIG. 2.

Figure 10:
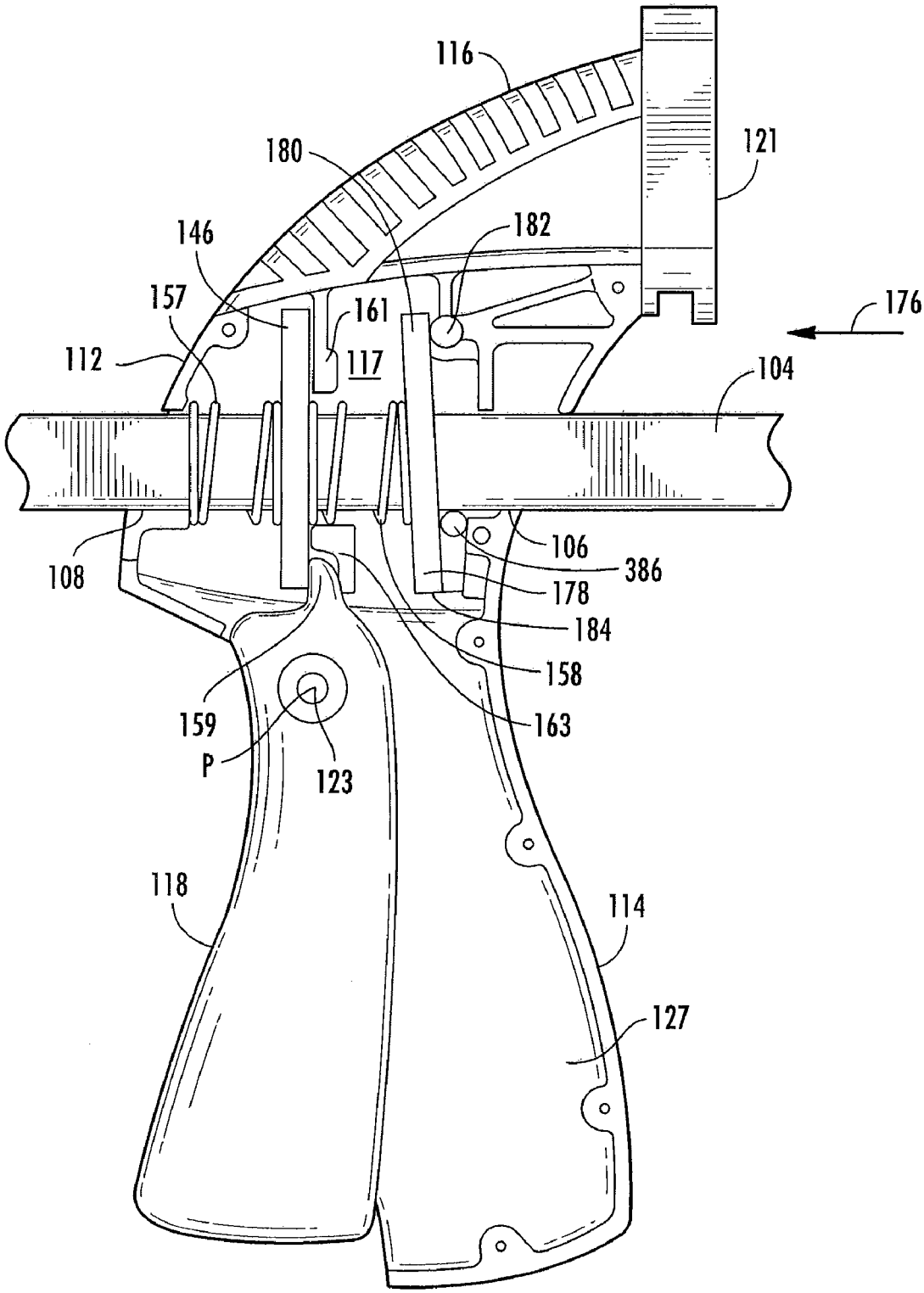
FIG. 10 shows a partially opened right side view of a second embodiment of a handle/grip assembly used with the bar clamp of FIG. 9 in accordance with the present invention.

As shown in FIGS. 9 and 10, the bar 104 is slidably supported in a proximal slot or bore 106 and a distal slot or bore 108, each of which passes through a handle/grip assembly 110. The handle/grip assembly 310 includes a clamp body 312 through which the slots 106 and 108 pass, a handle grip 114 attached to the clamp body 312 on one side of the slots 106 and 108, and a fixed clamping jaw 116 attached to the clamp body 312 on the other side of the slots 106 and 108. A cavity 117 in the clamp body 112 divides the bores 106 and 108 from one another. Note that the clamp body 312 is formed from left and right portions 127, 129. The left and right portions 127, 129 may be joined together via female and male members in a manner as described in U.S. Provisional Patent Application Ser. No. 60/395,800, the entire contents of which are incorporated herein by reference. On another matter, protective pads 119, 121 may be attached to the jaws 102 and 116, respectively.

A trigger handle 118 is pivotably mounted to the body 312 below and between the slots 106 and 108. In particular, the trigger handle 118 includes a pair of female receptors 123 located on opposite sides of the trigger handle 118. Corresponding annular male members 125 formed in left and right portions 127, 129 of the clamp body 112 are inserted into the female receptors 123. Once inserted in the receptors 123, the trigger handle 118 is pivotable about an axis P aligned with the receptors 123.

The bar 104 and clamping jaw 102 are incrementally moved toward the fixed clamping jaw 116 via the actuation of one or more driving levers 146. As shown in FIG. 10, the driving lever 146 is suspended on the bar 104, which passes through lower a rectangular hole formed in the driving lever 146. The driving lever 146 has a rectangular-like shape and is made of a resilient material, such as steel. Note that in the case when multiple driving levers are used, each driving lever 146 can be identical in shape.

As shown in FIG. 10, a pair of identical steel springs 157 and 158 is positioned at either side of the driving lever 146. Each of the springs 157 and 158 encircles the bar 104. The spring 157 has one end that engages a portion of the clamp body 312 near the slot 108 and another end that engages a rear face of the driving lever 146. The spring 158 has one end that engages a front face of the driving lever 146 and another end that engages a rear face of a braking lever 178. The configuration and structure of the springs 157 and 158 are such that they bias the driving lever 146 to a vertical position when the trigger handle 118 is not actuated as shown in FIG. 10. At this vertical position, the front face of the driving lever 146 contacts or is adjacent to an engagement piece 159 of the trigger handle 118 and an upper stop 161 and a lower stop 163 of the clamping body 312. Note that while the springs 157 and 158 are preferably identical, this is not necessary for the purposes of the present invention.

As shown in FIG. 10, a braking lever 178 is suspended from the bar 104. The bar 104 passes through a rectangular opening formed in the braking lever 178. A top end 180 of the braking lever 178 contacts a pivot element 182 formed in the clamp body 312. As shown in FIG. 10, when the trigger handle 118 is not actuated, the spring 158 biases the braking lever 178 so that it rotates counterclockwise and is angled with respect to the vertical direction. In this position, the braking lever 178 binds with the bar 104 when the edges of its opening engages the surface of the bar 104. Thus, the spring 158 normally simultaneously biases and positions the free end 184 of the braking lever 178 away from the trigger handle 118. The normally biased position of the braking lever 178 is limited by the binding interference and engagement between the opening of the braking lever 178 with the bar 104 so as to engage the bar 104 and prevent the bar 104 and the movable clamping jaw 102 from moving away from the fixed clamping jaw 116 while allowing the clamping jaw 102 to move towards the fixed clamping jaw 116.

If a force is applied to the movable jaw 102 of FIG. 9 in the direction indicated by the arrow 176, the bar 104 is free to move through the opening of the braking lever 178 and through the holes formed in the driving lever 146. Because the braking lever 178 is free to pivot against the bias of the spring 158 when force is applied on the movable jaw 102 in the direction of the arrow 176, the braking lever 178 does not engage the bar 104 and so does not present any obstacle to this motion of the bar 104 and the movable jaw 102 may be advanced continuously towards the fixed jaw 116.

Incremental motion of the bar 104 and the attached movable jaw 102 toward the fixed jaw 116 is made possible by squeezing the trigger handle 118 one or more times in a direction opposite to that indicated by the arrow 176. Squeezing of the trigger handle 118 causes the engagement piece 159 of the trigger handle 118 to push the driving lever 146 along the direction 176 shown in FIG. 10. Since the driving lever 146 engages the bar 104, the bar 104 travels with the driving lever 146 along the direction 176. As the trigger handle 118 is repeatedly squeezed, the movable jaw 102 approaches the fixed jaw 116 in an incremental manner. After a while, the object to be clamped will be engaged by both jaws 102 and 116. Continued squeezing of the trigger handle 118 causes the pressure or force exerted on the object and the jaws to increase.

Note that when the driving lever 146, braking lever 178 and the trigger handle 118 are not manually engaged and a force is applied to the movable jaw 102 of FIGS. 9 and 10 in the direction opposite to the direction indicated by the arrow 176, the edges of the opening formed in the braking lever 178 binds against the surface of the bar 104 and it is not possible, without further action, to withdraw the movable jaw 102 further away from the fixed jaw 116.

Figure 13:
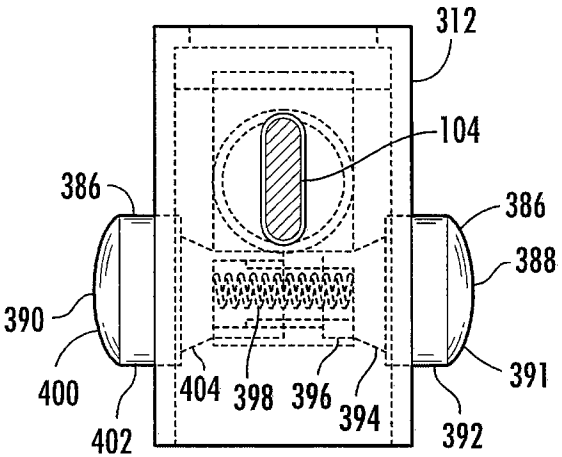
FIG. 13 shows a front view of the brake actuator of FIG. 11 prior to depression of the brake actuator.
Figure 11:
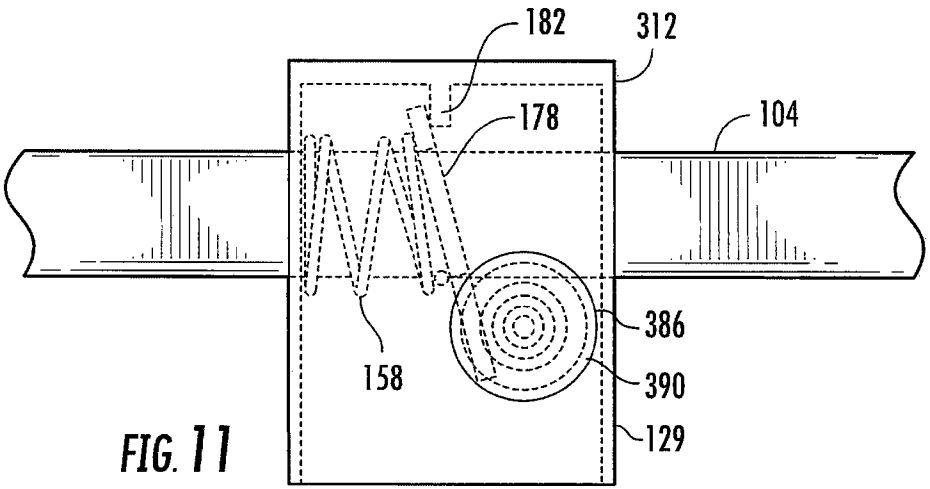
FIG. 11 schematically shows a right side view of a brake actuator to be used with the bar clamp of FIG. 9 prior to depression of the brake actuator in accordance with the present invention.
Figure 12:
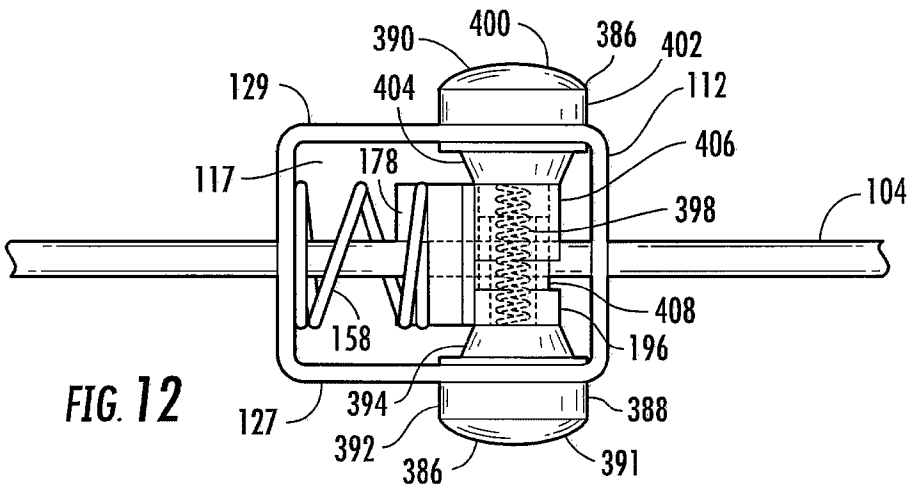
FIG. 12 shows a bottom view of the brake actuator of FIG. 11 prior to depression of the brake actuator.
Figure 14:
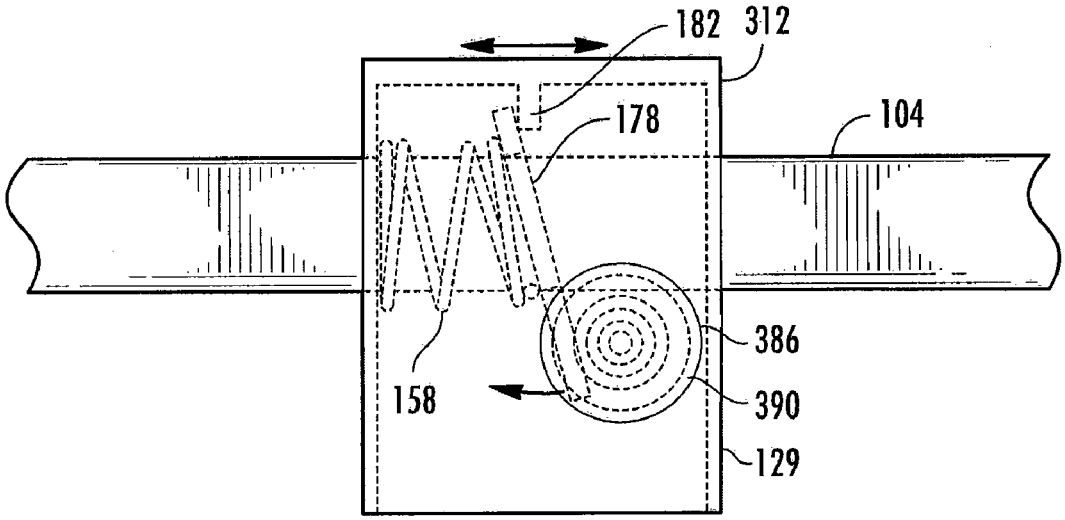
FIG. 14 shows a right side view of the brake actuator of FIG. 11 during depression of the brake actuator.

A clamped object is released from the jaws 102 and 116 by actuating a brake actuator 386. As shown in FIGS. 11-15, the brake actuator 386 includes two manual engagement elements 388, 390. One engagement element 388 includes a rounded top portion 391, a cylindrical section 392, a conical-like surface 394 and an annular neck 396. A longer annular piece 408 is integrally attached to annular neck 396. The conical-like surface 394 has a diameter that increases in a direction pointing from the annular neck 396 to the top portion 390. As shown in FIGS. 12 and 13, a spring 398 is inserted into an opening formed in the neck 396.

The other engagement element 390 has a shape that is similar to that of the engagement element in that it has a rounded top portion 400, a cylindrical section 402 and a conical-like surface 404 that are identical in configuration as items 390, 392 and 394 of the engagement element 388 as described previously. The engagement element 390 further includes an annular neck 406 that has an interior space that receives the longer annular piece 408. As shown in FIGS. 12 and 13, the spring 398 is inserted into the annular piece 408, which in turn is inserted into the annular neck 406. The spring 398 expansively engages both of the engagement elements 388, 390.

The cylindrical sections 392 and 402 are inserted into circular openings formed in the left and right portions 127, 129 of the clamp body 312 (note that the portions 127, 129 and 112 are schematically depicted in FIGS. 11-15 as rectangular box-like structures for reasons of clarity). The circular openings are opposite one another and face in a direction that is substantially perpendicular to the direction of movement of the bar. As shown in FIGS. 10-12, 14 and 15, the engagement elements 388, 390 are positioned so as to be adjacent to the braking lever 378. Note that the braking actuator 386 is schematically shown in FIG. 10 and the components of the clamp and the braking actuator 386 are not drawn to scale.

Figure 15:
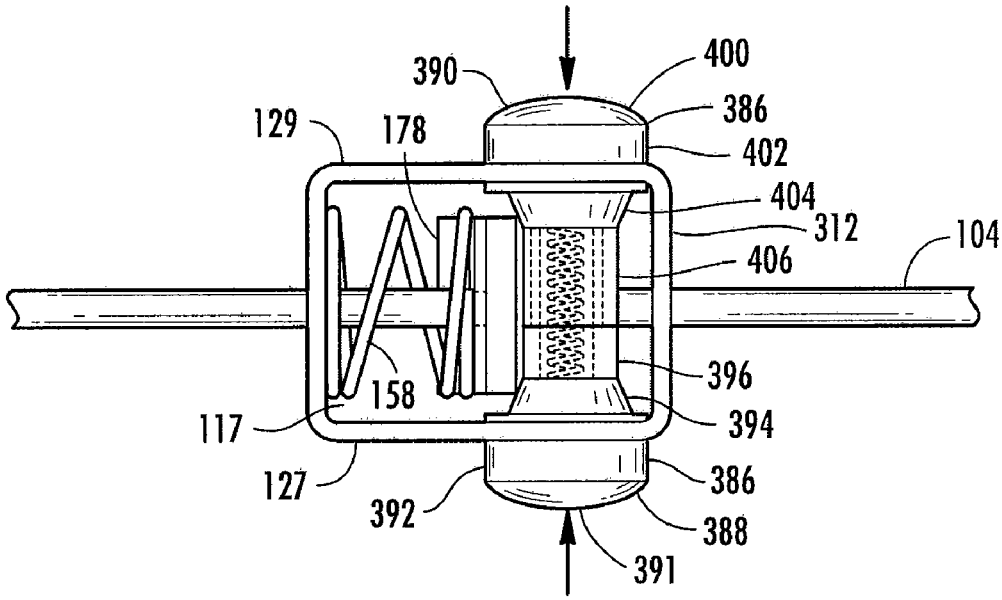
FIG. 15 shows a bottom view of the brake actuator of FIG. 11 during depression of the brake actuator.

Actuation of the brake actuator 386 is accomplished by having the thumb of the hand grasping the handle grip 110 and the trigger handle 118 be positioned so as to press against the nearest one of the top portions 391 and 400. Pressing either one of the top portions 391, 400 causes the corresponding cylindrical section and conical-like surface to translate towards and enter the cavity 117 as shown in FIG. 15. During such translation, the larger diameter portions of the corresponding conical-like surface engage the braking lever 178 and gradually cause the braking lever 178 to pivot about the pivot element 182 (see arcuate arrow of FIG. 15) and move to a substantially vertical or vertical position with respect to the direction of intended motion of the bar 104. Note that in the above actuation process, the brake actuator 386 allows most of the hand grasping the clamp to stay in contact with the clamp while the thumb engages a single brake actuator thus allowing for better control of clamp when releasing the braking lever 178. Note that if both top portions 391 and 400 of the engagement elements 388, 390 are depressed simultaneously, the braking lever 178 will move to the substantially vertical or vertical position as well.

Once the vertical or substantially vertical position is achieved, the edges of the opening of the braking lever 178 no longer bind with the bar 104. Accordingly, the bar 104 is free to slide in either direction (see double arrow of FIG. 15) through the openings in the driving and braking levers 146, 178. Based on the above description of the two modes of actuation, the brake actuator 386 increases the flexibility of operating the clamp by allowing actuation of the engagement elements at either side of the clamp body 112.

During pressing of one or more of the engagement elements 388, 390, the spring 398 is compressed as shown in FIG. 15. Accordingly, when the pressure on the engagement element(s) being depressed is discontinued, the spring 398 expands causing the engagement element(s) to translate outward to its original position shown in FIGS. 11-13. At this position, the braking lever 178 returns to its original position so that the movable jaw 102 and the bar 104 are again prevented from translating away from the fixed jaw 116.

Note that the bar 104 has a rectangular cross-section. Of course, the bar 104 may have other cross-sectional shapes, such as a square, a circle, or a triangle. The openings in the driving lever 146 and the braking lever 178 are shaped to accommodate the cross-sectional shape of the bar 104 to provide proper binding interference with the bar 104. Note that the bar 104 has a second opening 210. A cylindrical stop element 212 may be inserted into and permanently attached within the opening 212 so that the stop element 212 extends substantially perpendicular to the longitudinal axis of the bar 104. As the movable jaw 102 is moved away from the fixed jaw 116, the stop element 212 nears the rear of the slot 108. Upon reaching the rear of the slot 108, the ends of the stop element 212 contact the clamping body 112 outside of the slot 108. Thus, the stop element 212 prevents the movable jaw 102 from moving further away from the fixed jaw 116.

The bar clamp 300 of FIGS. 9-13 can be arranged to be a spreading clamp. This is accomplished by removing the movable jaw 102 in the manner described previously. Next, the bar 104 is removed from the clamp body 112 and reinserted so that the stop element 212 and opening 107 have switched positions. At this stage, the clamping jaw 102 is reattached to the bar 104, via opening 107, wherein the clamping pad 119 faces away from the clamping jaw 116.

The foregoing description is provided to illustrate the invention, and is not to be construed as a limitation. Numerous additions, substitutions and other changes can be made to the invention without departing from its scope as set forth in the appended claims.

We claim:

1. A clamp comprising:

a first clamping jaw;

a support element to which said first clamping jaw is attached;

a clamp body comprising:

a first slot through which said support element passes along a first direction, said first direction being a direction the support element moves to allow the first clamping jaw to move relative to a second clamping jaw;

a side portion that extends substantially parallel to said first direction; and a second slot in the side portion facing in a second direction that is substantially perpendicular to said first direction;

a handle grip attached to said clamp body;

a braking lever engageable with the support element and movable between a braking position and a release position; and a brake actuator that contacts said braking lever and comprises an ear that extends through said second slot such that the ear moves in said second slot relative to said side portion when the ear is actuated by a force applied to the ear such that the brake actuator moves the braking lever to said release position.

2. The clamp of claim 1, wherein said braking lever is normally positioned so as to engage said support element so as to prevent said support element and said first clamping jaw from moving away from said second clamping jaw and allowing said first clamping jaw to move towards said second clamping jaw.

3. The clamp of claim 1, wherein pressing of said ear of said brake actuator causes said braking lever to move to a position where said braking lever does not engage said support element.

4. The clamp of claim 3, wherein said braking lever pivots while moving to said position wherein said braking lever does not engage said support element.

5. The clamp of claim 2, wherein pressing of said ear of said brake actuator causes said braking lever to move to a position where said braking lever does not engage said support element.

6. The clamp of claim 5, wherein said braking lever pivots while moving to said position wherein said braking lever does not engage said support element.

7. The clamp of claim 1, wherein said clamp body comprises a third slot and said brake actuator comprises a second ear that extends through said third slot.

8. The clamp of claim 7, wherein pressing either said ear or said second ear along a pressing direction causes said braking lever to move to a position where said braking lever does not engage said support element.

9. The clamp of claim 8, wherein simultaneously pressing said ear and said second ear along said pressing direction prevents said braking lever to move to a position where said braking lever does not engage said support element.

10. The clamp of claim 8, wherein pressing either said ear or said second ear along a direction opposite said pressing direction prevents said braking lever to move to a position where said braking lever does not engage said support element.

11. The clamp of claim 8, wherein simultaneously pressing said ear and said second ear along a direction opposite said pressing direction causes said braking lever to move to a position where said braking lever does not engage said support element.

12. The clamp of claim 7, wherein said third slot faces in a direction substantially perpendicular to said first direction.

13. The clamp of claim 1, wherein said brake actuator has a trapezoidal shape.

14. The clamp of claim 13, wherein said brake actuator comprises a trapezoidal-shaped rib.

15. The clamp of claim 1, wherein said brake actuator defines an opening into which said support element is inserted.

16. The clamp of claim 1, wherein said clamp body comprises a recess and said brake actuator comprises an insertion member that is inserted within said recess.

17. The clamp of claim 16, wherein said clamp body comprises a second recess and said brake actuator comprises a second insertion member that is inserted within said second recess.

18. The clamp of claim 1, further comprising:

a trigger handle pivotably mounted to said clamp body; and a driving lever that is movable to a first position where said driving lever engages said support element and causes said support element to move relative to said clamp body, wherein pivoting of said trigger handle causes said driving lever to move to said first position and causes said support element to move relative to said clamp body.

19. The clamp of claim 1, wherein said support element comprises a rod.

20. The clamp of claim 1, wherein said support element comprises a bar.

21. A clamp comprising:

a first clamping jaw;

a support element to which said first clamping jaw is attached;

a clamp body comprising:

a first slot through which said support element passes along a first direction, said first direction being a direction the support element moves to allow the first clamping jaw to move relative to a second clamping jaw;

a side portion;

an opening defined by the side portion and facing in a second direction that is substantially perpendicular to said first direction; and a handle grip;

a braking lever engageable with the support element and movable between a braking position and a release position; and a brake actuator that contacts said braking lever and comprises an engagement element that extends through said opening such that the engagement element moves in said opening relative to said side portion when the engagement element is actuated by a force applied to the engagement element such that the brake actuator moves the braking lever to said release position.

22. The clamp of claim 21, wherein said braking lever is normally positioned so as to engage said support element so as prevent said support element and said first clamping jaw from moving away from said second clamping jaw and allowing said first clamping jaw to move towards said second clamping jaw.

23. The clamp of claim 21, wherein pressing of said engagement element of said brake actuator causes said braking lever to move to a position where said braking lever does not engage said support element.

24. The clamp of claim 23, wherein said braking lever pivots while moving to said position wherein said braking lever does not engage said support element.

25. The clamp of claim 22, wherein pressing of said engagement element of said brake actuator causes said braking lever to move to a position where said braking lever does not engage said support element.

26. The clamp of claim 25, wherein said braking lever pivots while moving to said position wherein said braking lever does not engage said support element.

27. The clamp of claim 21, wherein said clamp body comprises a second opening and said brake actuator comprises a second engagement element that extends through said second opening.

28. The clamp of claim 27, wherein pressing either said engagement element or said second engagement element along a pressing direction causes said braking lever to move to a position where said braking lever does not engage said support element.

29. The clamp of claim 27, wherein said second opening slot faces in a direction substantially perpendicular to said first direction.

30. The clamp of claim 21, wherein said engagement element comprises a conical-like surface.

31. The clamp of claim 30, further comprising a spring that biases said engagement element to a position where said engagement element does not engage said braking lever.

32. The clamp of claim 27, wherein said engagement element comprises a first conical-like surface and a first neck; and said second engagement element comprises a second conical-like surface and a second neck that is inserted into said first neck.

33. The clamp of claim 32, further comprising a spring that is inserted into said first neck and said second neck.

34. The clamp of claim 33, wherein said spring expansively engages both said engagement element and said second engagement element.

35. The clamp of claim 21, further comprising:

a trigger handle pivotably mounted to said clamp body; and a driving lever that is movable to a first position where said driving lever engages said support element and causes said support element to move relative to said clamp body, wherein pivoting of said trigger handle causes said driving lever to move to said first position and causes said support element to move relative to said clamp body.

36. The clamp of claim 21, wherein said support element comprises a rod.

37. The clamp of claim 21, wherein said support element comprises a bar.

38. A clamp comprising:

a clamping jaw;

a support member to which said clamping jaw is attached;

a clamp body comprising:

a channel through which said support member passes along a first direction, said first direction being a direction the support member moves to allow the first clamping jaw to move relative to a second clamping jaw, a side portion that extends substantially parallel to said first direction, a first slot that faces in a direction that is substantially perpendicular to said first direction, and a second slot in the side portion that faces in a direction that is substantially perpendicular to said first direction;

a handle grip attached to said clamp body;

a braking lever engageable with the support member and movable between a braking position and a release position; and a brake actuator that contacts said braking lever and comprises a first side, a second side, a first ear that extends through said first slot, a second ear that extends through said second slot, a first rib that is associated with said first ear, and a second rib associated with said second ear;

wherein said first ear comprises a front face on the first side of said brake actuator and a rear face on the second side of said brake actuator;

wherein said second ear comprises a front face on the first side of said brake actuator and a rear face on the second side of said brake actuator;

wherein in response to the front face of said first ear being pressed and the front face of said second ear being unpressed, said second rib actuates said braking lever to said release position; and wherein in response to the rear face of said first ear and the rear face of said second ear being pressed substantially simultaneously, said first and second ribs actuate said braking lever to said release position.

39. A clamp comprising:

a housing comprising a channel formed therein along a first direction and having a slot that faces in a second direction that is substantially perpendicular to said first direction;

a support member slidably received in said channel of said housing so that said support member moves along said channel in said first direction;

a handle grip attached to said housing;

a braking lever that is releasably engaged with said support member and movable between a braking position and a release position; and a brake actuator that contacts said braking lever and comprises an ear that extends through said slot;

wherein said brake actuator is allowed to pivot around an axis that is substantially parallel to the brake lever such that when the brake actuator is actuated by applying a force to the ear, the brake actuator moves the braking lever to said release position.

40. A clamp comprising:

a clamping jaw;

a support member to which said clamping jaw is attached;

a clamp body comprising:

a channel through which said support member passes along a first direction, wherein said first direction being a direction the support member moves to allow the clamping jaw to move relative to the clamp body;

a side portion that extends substantially parallel to said first direction; and a slot that faces in a direction that is substantially perpendicular to said first direction;

a handle grip attached to said clamp body;

a braking lever engageable with the support element and movable between a braking position and a release position; and means for tilting said braking lever relative to said support member and comprising an ear that extends through said slot such that the ear moves in said second slot relative to said side portion when the ear is actuated by a force applied to the ear such that the tilting means moves the braking lever to said release position.

41. A clamp comprising:

a movable and clamping jaw;

a support member connected to said jaw;

a clamp body comprising:

an upper portion having a channel through which said support member passes along a first direction and having a slot, said first direction being a direction the support member moves to allow the movable jaw to move relative to the clamping jaw, a lower portion, and a side extending from said upper portion to said lower portion;

a handle grip attached to said lower portion of said clamp body;

wherein the slot is disposed in the side, the slot facing in a second direction that is substantially perpendicular to said first direction;

a braking lever engageable with the support member and movable between a braking position and a release position; and a brake actuator that contacts said braking lever and comprises an ear that extends through said slot;

wherein said ear translationally moves from one edge of the slot to an opposite edge of the slot to move the braking lever to said release position;

wherein said ear is capable of actuation from said side;

wherein said lower portion is orientated in a second direction that is substantially perpendicular to said first direction; and wherein said slot faces in a direction that is substantially perpendicular to said second direction and substantially perpendicular to said first direction.

* * * * *